United States Patent [19]

Chang

[11] Patent Number: 4,820,358

[45] Date of Patent: Apr. 11, 1989

[54] METHOD OF MAKING HIGH STRENGTH SUPERALLOY COMPONENTS WITH GRADED PROPERTIES

[75] Inventor: Keh-Minn Chang, Schenectady, N.Y.

[73] Assignee: General Electric Company, Schenectady, N.Y.

[21] Appl. No.: 32,661

[22] Filed: Apr. 1, 1987

[51] Int. Cl.[4] ..... C22F 1/10

[52] U.S. Cl. ..... 148/13; 148/162; 148/410; 148/428

[58] Field of Search ..... 148/2, 3, 11.5 N, 12.7 N, 148/13, 162, 409, 410, 426–429

[56] References Cited

U.S. PATENT DOCUMENTS 4,529,452 6/1985 Walker ..... 148/11.5 Q 4,608,094 8/1986 Miller et al. ..... 148/11.5 N

*Primary Examiner*—R. Dean

*Attorney, Agent, or Firm*—Paul E. Rochford; James C. Davis, Jr.; James Magee, Jr.

[57] ABSTRACT

A novel heat treatment of a disk for a jet engine is provided. A temperature gradient is established on the disk to heat the inner portions to a temperature at which a subsolvus anneal takes place and to heat the outer portions to a temperature where a supersolvus anneal takes place. A reverse gradient is established from the inner portions of the disk during cooling after the anneal to cool the inner portions of the disk more rapidly than the outer portions so as to impart high tensile and fatigue strength to the inner portions and high temperature rupture life and crack growth resistance to the outer portions. A novel disk results.

6 Claims, 8 Drawing Sheets

METHOD OF MAKING HIGH STRENGTH SUPERALLOY COMPONENTS WITH GRADED PROPERTIES

RELATED APPLICATIONS

The subject application relates to copending application Ser. No. 907,550 filed Sept. 15, 1986 and assigned to the same assignee as the subject application. The subject application also relates to application Ser. No. 674,449 filed Dec. 3, 1984 and now the subject of publication in at least one foreign country.

BACKGROUND OF THE INVENTION

The present invention relates generally to articles made with superalloys for use at high temperature and high stress. More particularly it relates to components of jet engines and turbines which are formed of superalloy materials and which are used in service at high temperatures and high applied stress.

It is known that superalloys including nickel-base and iron-base superalloys have been employed extensively in applications which require high strength at high temperature. The design of jet engines has in large part been determined by the properties which superalloys used as fabricating materials for components of the engine can display. As the properties of the alloys are improved the design of the jet engine improves and greater thrust to weight ratios are achieved. Generally higher temperature operation results in greater fuel efficiency for such engines and the drive for higher operating temperatures and for superalloy materials which can operate at such higher temperatures is a continuous design criteria in fabrication of more and more efficient jet engines. The need for higher temperature capability in high strength superalloys continues as efforts are made to continue to improve operating performance for jet engines.

Many metallurgical advances have assisted in improving high strength superalloys. These have included the increase in the precipitate volume fraction for the gamma precipitate strengthening agent of such alloys. Also improvements have been made through powder metallurgy and through the use of isothermal forging. Improvements in the alloy temperature capability of superalloys have been achieved.

It has also been recognized that not all components of a jet engine are subject to the same operating conditions and that different metallurgical compositions may be employed in different components of the engine to best suit the needs for that component. Also it has been found that different heat treatments of a single composition can result in different combinations of properties and such different heat treatments have been employed depending on the use and application of the engine part and the function which it serves in the overall engine.

However, there are some parts where tradeoffs have been made in properties because the part is large enough so that the engine operating conditions over the full extent of the part are not uniform. In other words, certain large pieces which are installed in an engine encounter different temperatures and different property requirements in service from one portion of the component to another. As is known, conventional thermal processing imparts an identical thermal history to each portion of a component and generates the same microstructure and properties throughout the whole component. Accordingly, for such large components it is necessary to sacrifice a property at one location of the component in order to obtain an acceptable property at another location.

For example, among the many critical mechanical properties required by highly stressed components, crack growth resistance and high temperature rupture life are highly desired properties. Such properties are needed, for example, in engine disks which rotate at high speeds and result in the application of high stress to portions of the disk and particularly to the outer portions of the disk. A number of improvements have been made recently in crack growth resistance of superalloys employed in forming such disks and also in the enhancement of high temperature rupture life for such disks.

The prior art heat treatment practice for high strength superalloys employs subsolvus annealing and rapid cooling in order to generate a fine grain structure and high strength. Subsolvus annealing is an annealing at a temperature below the solvus temperature, i.e., the temperature at which all $\gamma'$ strengthening precipitate goes into solution. The subsolvus annealing is also known as partial solutioning. The conventional cooling rate after annealing is the fastest rate which is possible providing that no quench defect is induced in the part. Alloys receiving this kind of conventional heat treatment show good tensile and fatigue strength but their high temperature rupture life is comparatively short. Improvements in high temperature rupture life can be accomplished by supersolvus annealing to generate a large grain size.

An illustration of the different results and different properties which are imparted to a single base superalloy is illustrated in the data which is plotted in FIG. 1.

Referring now first to FIG. 1, it is evident from the plotted data that for a sample of René 95 prepared by powder metallurgy techniques a 100 hour rupture life test was performed. The test applied a level of stress to the sample as plotted in the ordinate and the sample was heated to the various temperatures noted in the abscissa of the plot of temperature in degrees Fahrenheit. At 1000° F. the material which had been annealed at subsolvus temperature was stressed at about 190 ksi and can endure for 100 hours with this stress at that temperature. At 1100° F. the stress which can be endured for 100 hours is about 170 ksi. At 1400° F. the stress which can be endured by the subsolvus annealed material is about 50 ksi.

In contrast with the results obtained for the subsolvus annealed material, the supersolvus annealed material can be seen to have a much higher stress at 1400° and, in fact, about 90 ksi. The rupture strength for 100 hour life is plotted as a function of temperature for subsolvus and supersolvus annealed materials, respectively. The two rupture curves show a crossover at about 1240° F. At a stress of about 80 ksi the supersolvus annealing offers about +100° F. temperature capability over the subsolvus annealed material. In contrast the latter, that is the subsolvus annealed material, has a much higher strength than the supersolvus annealed material at low temperatures.

The cooling rate after annealing also affects alloy properties significantly. Generally, higher cooling rates result in higher tensile strengths for the same composition. FIG. 2 is a plot of the strength of a René 95 sample prepared by powder metallurgy plotted as the ordinate against the cooling rate employed in cooling the sample as the abscissa. The yield and tensile strengths were measured on samples at 1200° F. and results are plotted in FIG. 2. It is noted that as the cooling rate in degrees Centigrade per minute increases, that both the yield strength and the tensile strength of the samples increases based on the different cooling rates after annealing and based particularly on the increased cooling rate. In other words, it has been found that the higher the cooling rate employed in affecting the cooling of the sample, the higher the strengths that are obtained. This same finding of increased strength with increased cooling rate is found to be the case for both subsolvus annealed and supersolvus annealed samples.

The most striking effect of cooling rate on the properties of a supersolvus annealed sample are identified to be the fatigue crack growth resistance under time dependent conditions. This is described in the copending application Ser. No. 907,550 filed Sept. 15, 1986. An example to illustrate the time dependence of fatigue crack propagation is given in FIG. 3. In FIG. 3 the rate of crack propagation, da/dN, in inches per cycle is plotted against the cooling rate in ° C. per minute. The fatigue crack growth rate for the samples was measured at 1200° F. by employing three cycle waveforms as follows: The first was a 3 second sinusoidal cycle. The second was a 180 second sinusoidal cycle. The third was a 177 second hold at the maximum load of a 3 second sinusoidal cycle. In these tests the maximum to minimum load ratio was set at R=0.05. From the data plotted in FIG. 3, it is evident that for a given cyclic stress intensity, $\Delta K = 30\ \text{ksi}\sqrt{\text{in}}$, the crack growth da/dN, of fast cooled René 95 increases dramatically as the cycle frequency decreases or as the hold time is applied. From the graph of FIG. 3, the lowest increase in crack growth rate is seen to be for the 3 second cycle. The 180 second cycle is seen to be dramatically higher than that of the 3 second cycle and the 3 second cycle with 170 second hold at maximum stress is seen to have a dramatically greater crack growth propagation rate. For example, and with reference again to FIG. 3, at a cooling rate of 750° C. per minute the da/dN for the 180 second cycle is about 0.006 inches per cycle while that for the 3 second cycle is about 0.00004 inches per cycle.

The time dependence of the da/dN, that is of the crack growth rate, becomes less and less when the cooling rate after supersolvus annealing is reduced to greater and greater extents. These, and again from the data plotted in FIG. 3, at a cooling rate of 100° C. per minute the da/dN for the 180 second cycle is about 0.00002 inches per cycle while that for the 3 second cycle is about 0.00004 inches per cycle.

From the foregoing it is evident that the optimum thermal processing for high temperature capability with resistance to crack propagation or growth is completely different from that for high strength.

BRIEF DESCRIPTION OF THE INVENTION

It is accordingly one object of the present invention to provide articles for use in operating components, such as jet engines, which have preferred sets of properties for use at the actual operating conditions of the jet engine.

Another object is to be provide a means by which optimum operating properties may be provided in a relatively large size component of a jet engine.

Another object is to provide a scheme which permits optimum properties to be achieved in a structure, the operating conditions for which are complex or varied.

Another object is to provide a method for improving the operating characteristics of relatively larger components of jet engines.

Other objects will be in part apparent and in part pointed out in the description which follows.

In one of its broader aspects, objects of the present invention can be achieved by providing a disk having a small grain size throughout its structure and at both an outer rim portion and an inner bore portion, heating said disk to about its annealing temperature to establish a temperature gradient of at least 50° C. over the radius of said disk to bring the rim portion of said disk to above its supersolvus annealing temperature but below its incipient melting temperature to substantially enlarge the grain size of the grains at the rim of said disk, and to heat the bore portion of said disk structure to a subsolvus annealing temperature to dissolve only a portion of the gamma prime strengthening precipitate therein and to limit grain growth to less than that occurring in the rim portion of the disk, cooling the disk while preserving a radial temperature gradient therein to cool the bore portion of said disk at a rate which is at least twice as rapid as the rate at which the rim portion is cooled, to thereby impart a different set of mechanical properties to the bore portion as compared to the rim portion.

BRIEF DESCRIPTION OF THE DRAWINGS

The specification of the invention which precedes and follows will be better understood by reference to the accompanying drawings in which.

DETAILED DESCRIPTION OF THE INVENTION

Figure 1:
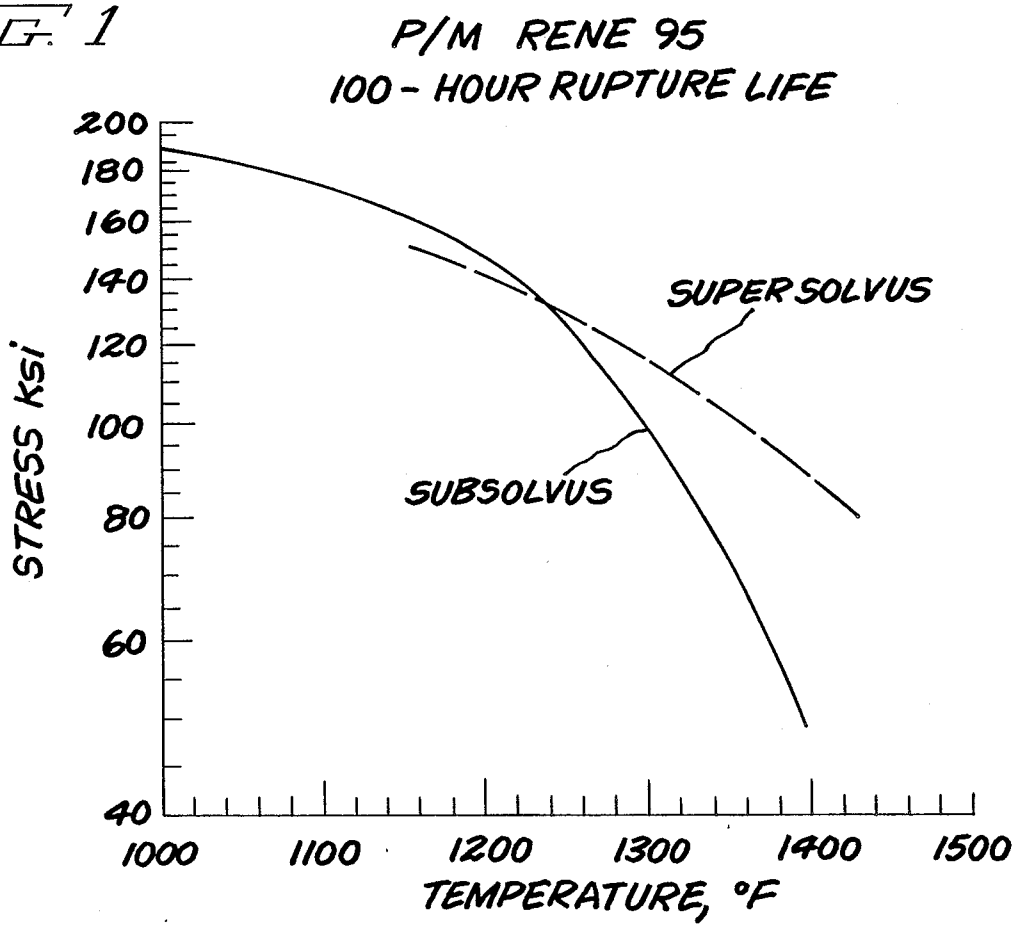
FIG. 1 is a graph in which stress in ksi is plotted against temperature in ° F. and which displays 100 hour rupture life test results for tests of René 95 treated according to certain heat treatment procedures.
Figure 2:
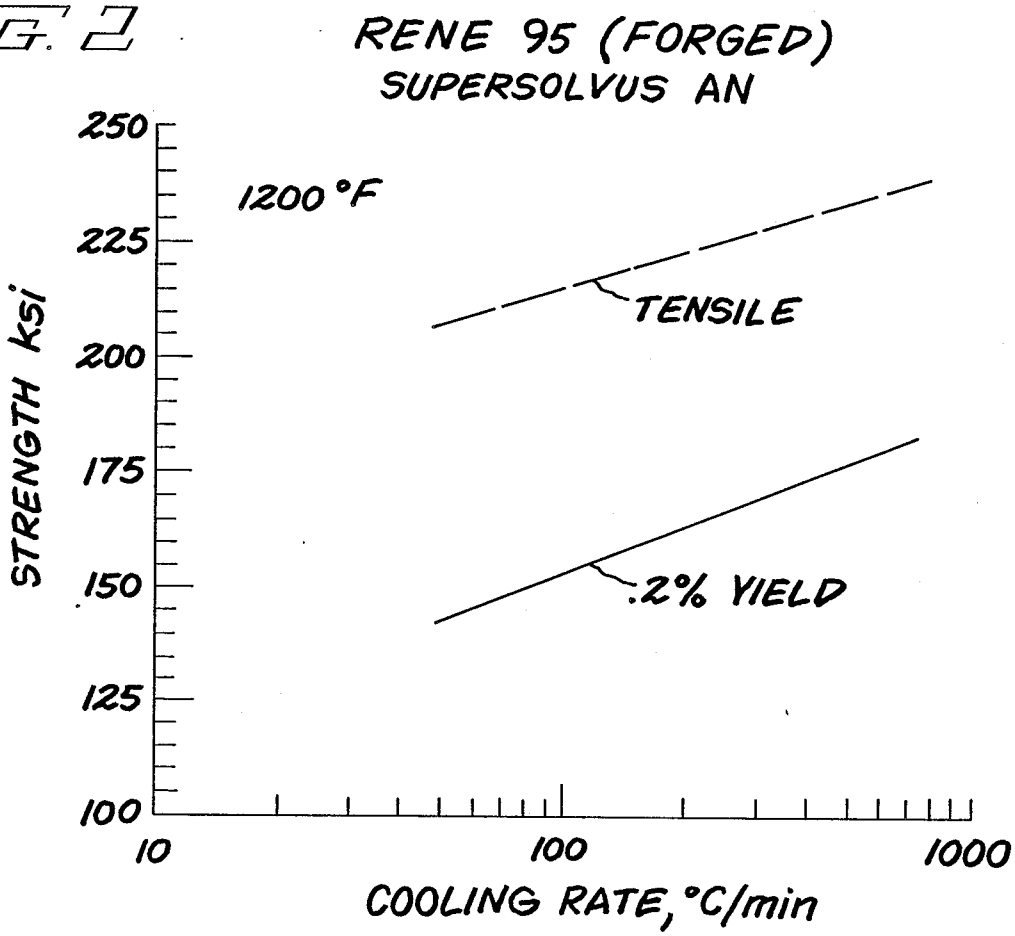
FIG. 2 is a graph in which strength in ksi is plotted against cooling rate in ° C. per minute for a sample of René 95 and showng different strength properties depending on the rate of cooling of the sample.
Figure 3:
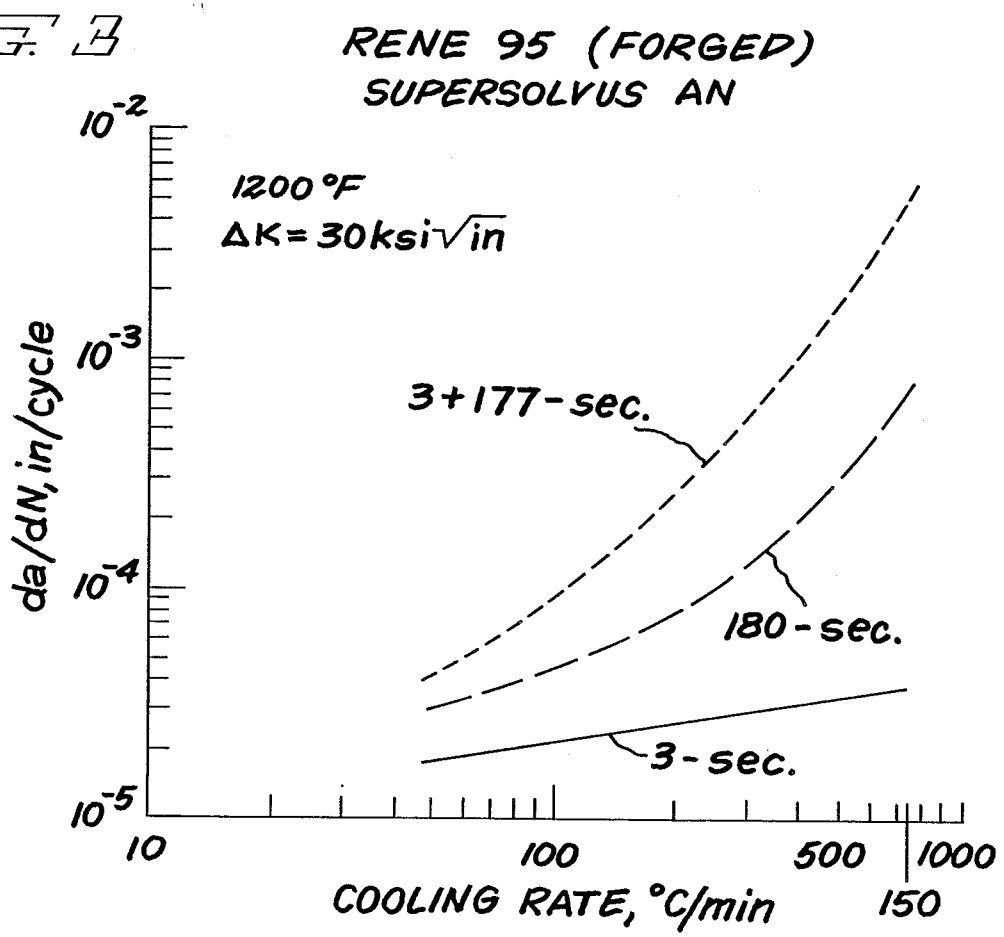
FIG. 3 is a graph in which the crack propagation rate, da/dN, in inches per cycle is plotted against a cooling rate in ° C. per minute for samples of René 95 which were tested at three different cycles of stress.

Under prior art practice, a disk having a profile as illustrated in FIG. 4 has a relatively thick inner portion extending from the bore outward and has a relatively thin outer portion extending from the rim inward. Under prior art practice the high pressure turbine disk having the profile as illustrated in FIG. 4*b* is heated uniformly to a high temperature to partially dissolve the strengthening gamma prime precipitate. In other words, all portions of the disk including the inner and outer portions are heated to the same annealing temperature. Because of this uniform heating all portions have the same small grain size. These small grains favor the development of high strength at the base portion of the disk but the small grains are detrimental to the development of long rupture life at the rim portions which will see high temperature in service in a jet engine.

Also, because the inner portion extending from the bore has a heavy thickness it undergoes a relatively slow cooling from the annealing temperature during the cooling or quenching operation which follows the anneal. Such slow cooling during the quenching results in a low strength at the inner portions of the disk. However, what is needed at the inner portion of the disk is high strength.

On the other hand the thinner rim area and portions extending inward from the rim will be cooled faster after the annealing. Because of this fast cooling the crack propagation rate, da/dN, will show strong time dependence. However, what is needed at the outer portions of the disk is a crack propagation rate which is not time dependent.

Both of these results are precisely the opposite of those which are desired and needed for optimum properties and optimum operation of a disk in service in a jet engine.

In contrast pursuant to the present invention, a directional heat flow is established by setting up the source of heat to be incident on the disk from around the rim of the disk and to provide a heat sink near the bore of the disk. In this way, both the rim and the bore can receive their own optimum thermal processing.

In a steady state a temperature gradient is established from the bore to the rim. The end temperatures reached by the heat input and the temperature gradient established over the radius of the disk are controlled by the heat input and output to and from the rim and bore. In this way the annealing is done with the rim at a higher supersolvus temperature and with the bore at a lower subsolvus temperature and with the portions of the disk extending from the rim to the bore at temperatures therebetween.

After the annealing has been accomplished and a part of the gamma prime precipitate has been dissolved at the bore of the disk and has been totally dissolved at the rim of the disk, the heat supply to the disk is revised so that rapid cooling is accomplished near the bore of the disk and a more leisurely and slow cooling is accomplished at the rim of the disk.

Where a directional heat flow is set up by placing the heat source around the rim and heat sink near the bore, then the optimum thermal processing can be accorded to both the rim and the bore. In part this is done by creating a temperature gradient of increasing temperature from the bore to the rim. The final temperatures to which the disk is heated as well as the temperature gradient established by this heating are controlled by the heat input and output to and from the outer rim portion of the disk and the inner bore portion of the disk.

After the annealing or in other words the heat input, a desirable cooling rate can be achieved through a rapid heat output and through a slow or even zero heat input. The bore of the disk receives a fast cooling at the end of the lower temperature or subsolvus annealing. The rim receives a slow cooling after a higher temperature or supersolvus annealing.

Figure 4A:
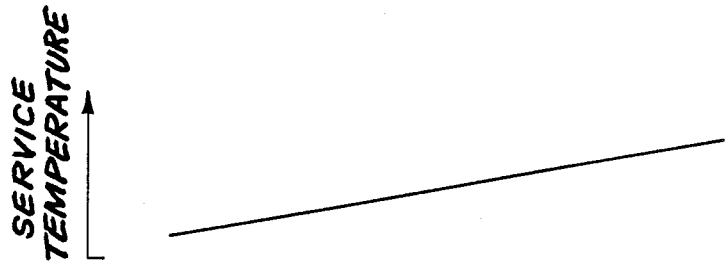
FIG. 4 is a series of graphs together with an outline, 4*b*, of the cross section of the radius of a disk is shown extending from the bore to the rim of the disk. Also illustrated in the figure are the service temperature profile, 4*a*, over the radius of the disk and the annealing temperature profile 4*c* for the annealing of the disk and also the cooling rate profile 4*d* for the cooling of the disk.
Figure 4B:
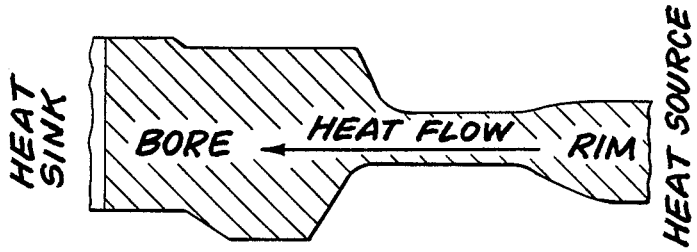

Some of these relationships are illustrated in FIG. 4 where a profile of a rim is shown as FIG. 4B. The gradient service temperature expected for the disk shown in radial relation from bore to rim is illustrated in FIG. 4A. Based on this projected service temperature, the gradient of annealing temperatures is illustrated in FIG. 4C and the gradient of cooling rate is illustrated in FIG. 4D.

A disk receiving such a novel thermal treatment will have the bore portion with high tensile and fatigue strength combined with a rim portion of good high temperature rupture life and superior crack growth resistance.

The manner in which a thermal gradient may be established over the radius of the disk may be understood by further reference to the Figures.

Figure 5:
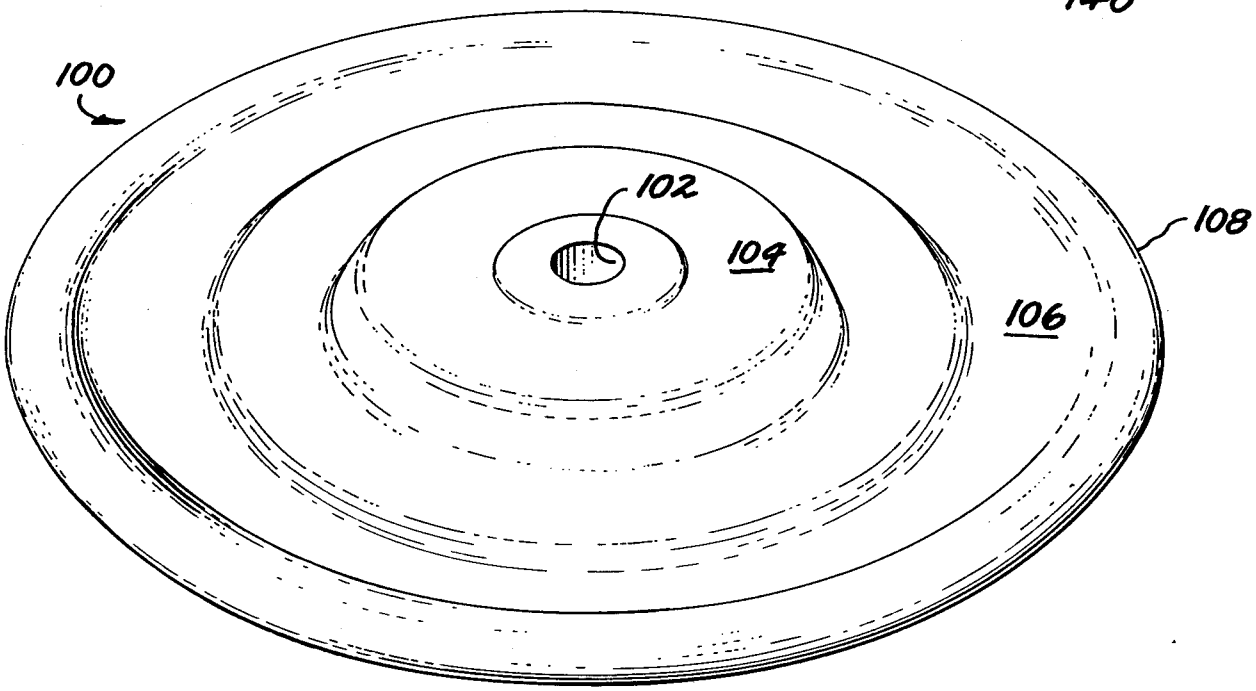
FIG. 5 is a perspective view of a disk such as may be treated pursuant to the present invention.

FIG. 5 is a typical disk which may be conditioned pursuant to the method of the present invention. The disk 100 has a center opening or bore 102 by which it may be mounted on a shaft for rotation in a jet engine. The contours of the disk surface conform approximately to those of the disk shown in section in FIG. 4B. The disk has an inner and thicker bore portion 104 and an outer and thinner rim portion 106 extending in from the rim 108.

Disks, such as that illustrated in FIG. 5, are used in a variety of jet engines of different sizes. Disks having diameters of about 9 inches are used in small engines and disks having diameters of three and four feet and more are used in large engines. The process of the present invention can be employed in improving properties of disks of these different sizes.

The advantage of the invention is greatest where the temperature gradient developed during use of the disk in a jet engine is greatest. A temperature gradient develops over the radius of essentially all disks in actual use in jet engines. For the smaller engines and smaller disks and for engines which are operated at lower temperatures, the temperature gradient over the radius of the disk is smaller.

The significance not only of the temperature differential but also the respective temperatures at which the bore portion and rim portion of a disk operate may be illustrated with reference to the content of FIG. 1. FIG. 1 is a plot of 100 hour rupture life for two samples of the same René 95 superalloy which were prepared by powder metallurgy and one of which was then subjected to a supersolvus anneal while the other was subjected to subsolvus anneal. The two different sets of properties shown over the temperature range of up to 140° F. is the result of the two different treatments. Other alloys have other rupture life as temperature profiles of course. For most superalloys, there is however a cross over of properties while in FIG. 1 is seen to occur at 1240° F.

The optimum advantages of the present invention are achieved when a disk is operated in a jet engine so that its rim portion is at a temperature above the cross over temperature and the bore portion is operated at a temperature below the crossover temperature. For the René 95 superalloy of FIG. 1, such operation would be with a bore temperature below 1240° F. and with a rim temperature above 1240° F. Also, the advantage of the present invention is greater where the temperature differential or temperature gradient from the inner to the outer portions of the disk is greater. This is also partially evident from the graph of FIG. 1 inasmuch as the property difference between the subsolvus curve and the supersolvus curve increases with increase in temperature. Thus, at about 1300° F. the subsolvus sample has a 100 hour rupture life at a stress of less than 100 ksi. At 1300° F. the sample with the supersolvus anneal has a 100 hour rupture life at about 115 ksi. The difference is about 15 ksi.

Similarly, at 1350° F. the subsolvus anneal sample has a stress value of about 72 ksi and the supersolvus anneal sample has a stress value of over 100 ksi. The difference is about 30 ksi.

At 1400° F. the subsolvus annealed sample has a stress value of less than 50 ksi, while the supersolvus anneal sample has a stress value of about 90 ksi. The difference is about 40 ksi.

From the foregoing analysis of the data of FIG. 1 it is evident that the value of the property difference between the inner and the outer portions of a disk is greater as the difference in operating temperature between the inner and outer portions in increased.

Figure 8:
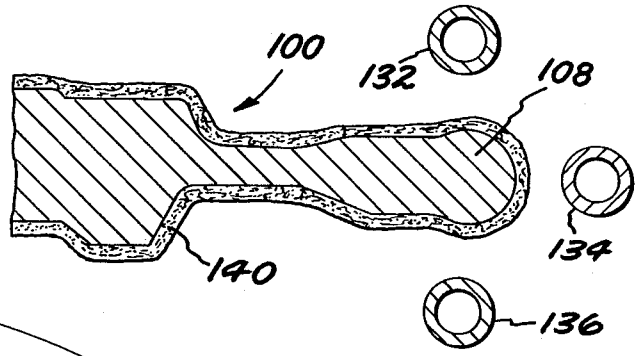
FIG. 8 is a perspective view of a disk mounted within a set of induction heating coils and displaying the positive and negative electrodes.
Figure 6:
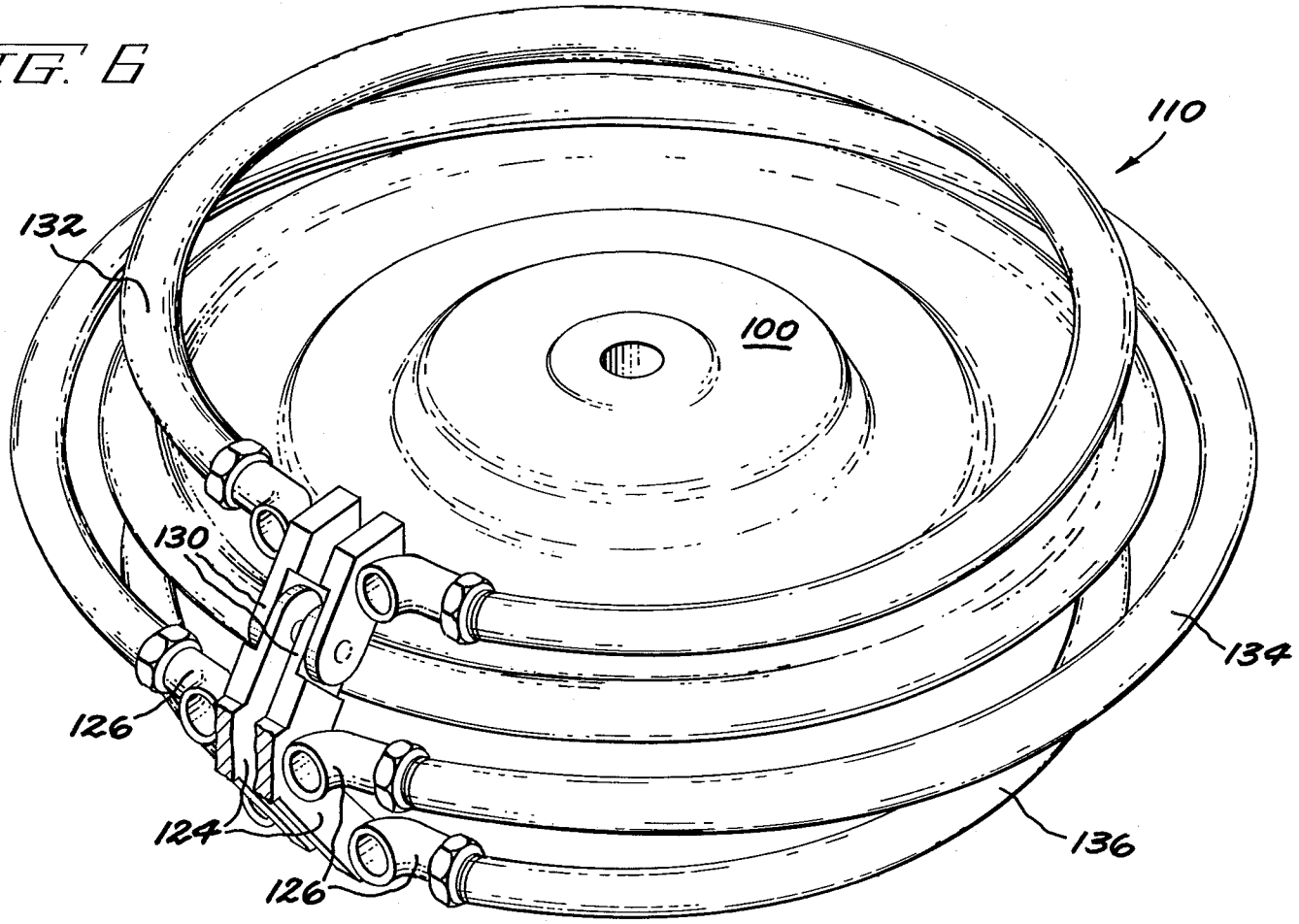
FIG. 6 is a vertical section of such a disk mounted within a set of coils extending around the rim of the disk.

Turning now to FIG. 6, the disk 100 as seen in FIG. 5 is enclosed within a three element induction heating coil 110. FIG. 6 is a perspective semi-schematic illustration of the arrangement of the disk within conforming coils of an induction heating apparatus. A better view of the relationship of the individual coils to the rim portion of the disk to which they are to deliver heat is shown in FIGS. 7 and 8.

In general, the heat treatment of a disk is carried out pursuant to this invention by generating a temperature gradient in the disk radius by putting heat into the disk at the rim and taking it out at the bore of the disk.

Figure 7:
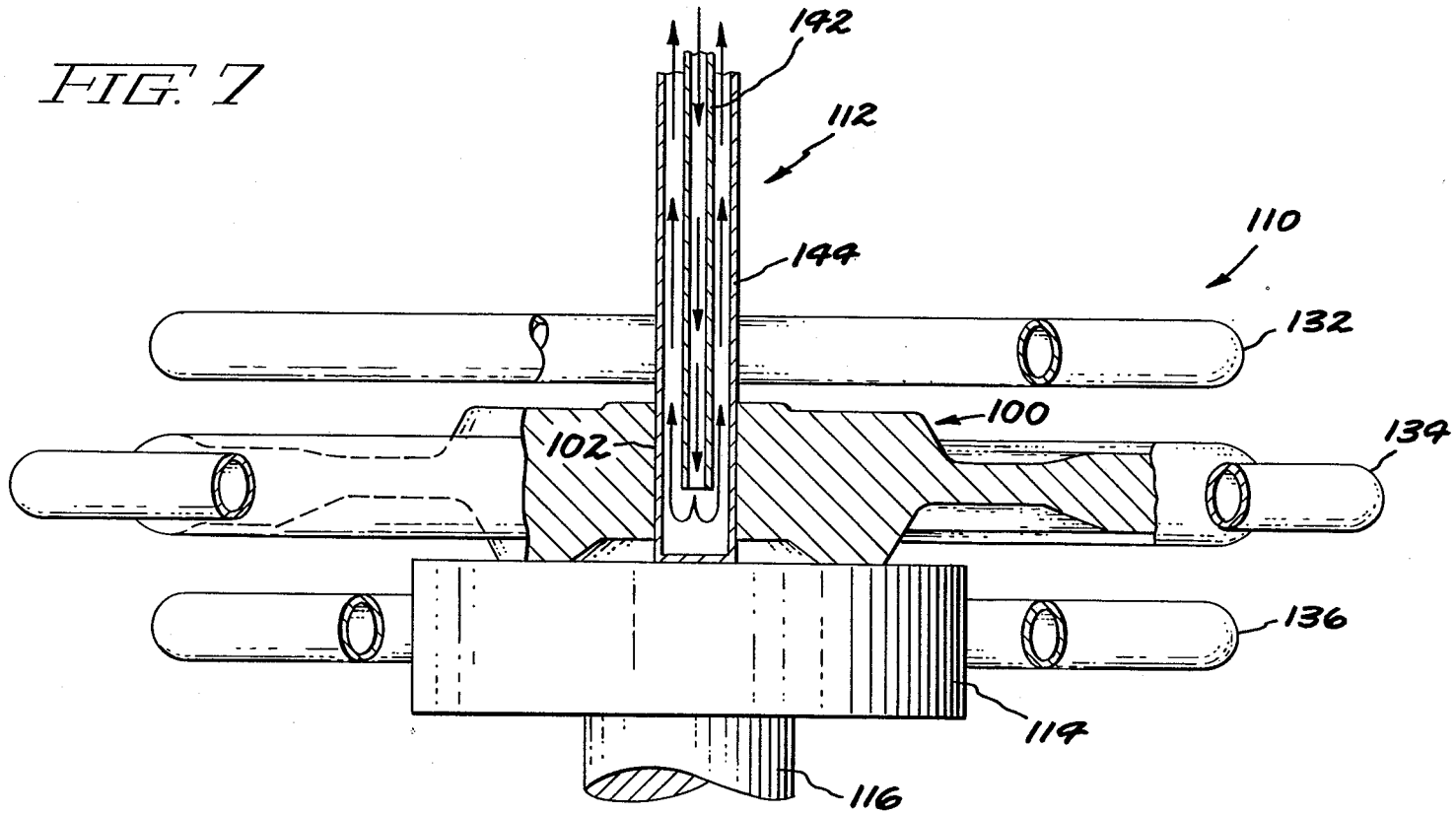
FIG. 7 is an elevational view in part in section of details of the cooling probe in relation to the disk and heat source.

For this purpose, as is evident from FIG. 7, heat is put into the disk at the rim by induction heating through the coil 110 and it is taken out from the bore of the disk through an internally cooled probe 112.

Figure 9:
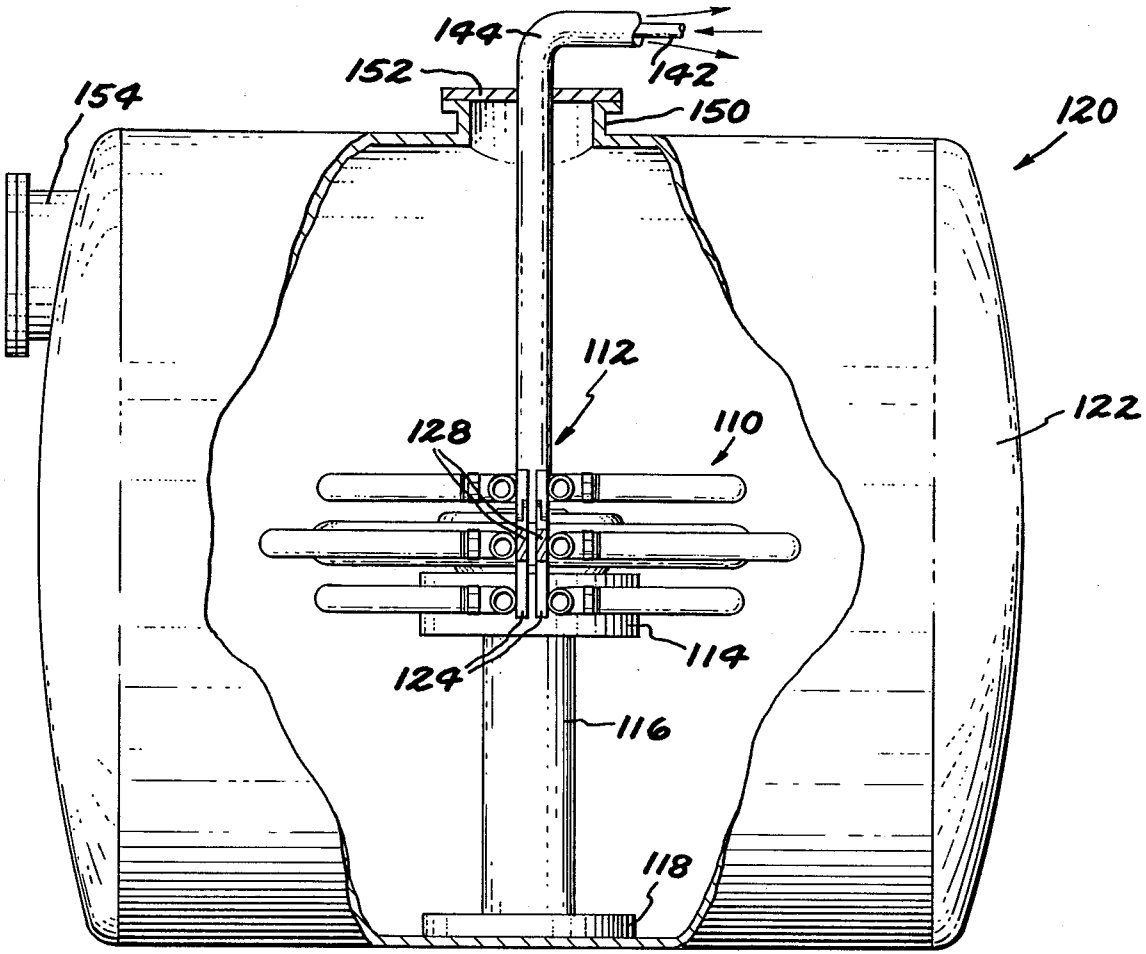
FIG. 9 is a sectional view of a disk and set of coils within a vacuum furnace enclosure.

For the purpose of this heat treatment, the disk may be mounted on a platform 114 on a pedestal 116 which is in turn mounted on a base 118 within a vacuum furnace 120 as best seen in FIG. 9. The furnace 120 is in essence a large tank which may be cylindrical and which has at least one end door 122 to permit access to the furnace interior. The tank may conveniently have a diameter of about five feet for treatment of disks having diameters of about 3 feet.

FIG. 9 is semi-schematic as are all of the other apparatus figures and shows only essential elements of the apparatus for convenience of illustration. Other heating, cooling, sensing and measuring elements used with such an apparatus are conventional and are well known in the art. For example, the coils of induction heating furnace elements 110 are tabular as is evident from FIG. 7 where the tubes are partially cut away for clarity of illustration. Cooling medium is flowed through the coils by means not shown because such coolant supply is well known and conventional.

Similarly, induction power is fed to the tubes of induction furnace 110 through bars 124 to which the tubes 110 are mounted at elbows 126 which elbows are brazed to bars 124. Break surfaces 128 are shown for bars 124 where they are connected to conventional power supply means not illustrated.

For convenience, the bars 124 are hinged at hinge portions 130 to permit one side of the upper induction coil 132 to be raised relative to lower coils 134 and 136 so that the disk 110 can be conveniently inserted in place for treatment and removed after treatment.

It is evident from FIG. 7 and even more so from FIG. 8 that the preferred placement of the individual coils relative to the rim of the disk to be heated is one in which one coil 134 is placed radially outward from rim 108 of disk 100. The remaining coils 132 and 136 are placed above and below rim 108 respectively essentially in the formation illustrated in FIG. 8. FIG. 8 is a partial sectional view of one side of the disk and of the coils which are so disposed as to impart heat to the rim by induction heating.

In FIG. 8, layer of insulation 140 is shown wrapped about the disk 100. The insulation is useful in keeping to confine heat introduced into the disk to the body of the disk so that much of the heat enters the rim of the disk and flows to the rim where it is removed through coolant probe 112. The extent of the use of an insulating layer and the thickness of the layer at different distances along the rim radius is that which is effective in generating the annealing temperature in the disk according to the graph of FIG. 4C.

Figure 4C:
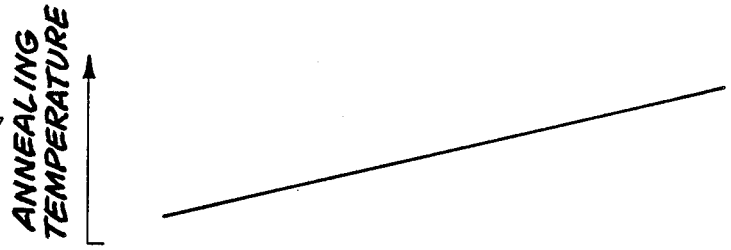
Figure 4D:
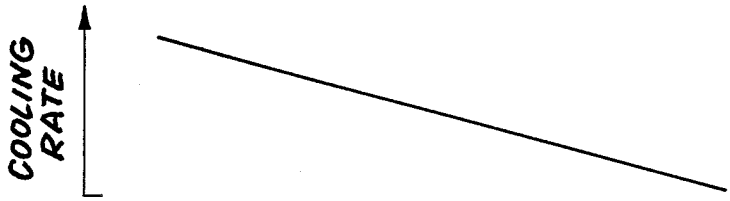

After the annealing with a temperature gradient as illustrated in FIG. 4C, cooling rate gradient is established in the disk as illustrated in FIG. 4D to accomplish a more rapid cooling of the bore portion of the disk relative to the slower cooling of the rim portion of the disk. The more rapid cooling of the bore portion is accomplished by adjusting the type and the flow of coolant to the cooling probe 112. The less rapid cooling of the rim portion may be accomplished by keeping the insulation layer in place. In addition, it may be accomplished by a lower level introduction of heat to the rim portion by the induction coils 110.

The cooling probe 112 itself is made up essentially of two concentric fluid conducting tubes or pipes on inner tube 142 of which carries a cooling fluid such as cooling gas or liquid into the probe and the outer tube 144 of which carries the cooling fluid into heat removing relation to the outer pipe 144 and accordingly to the bore 102 of disk 100. Greater or lesser cooling can be accomplished by passing greater or lesser quantities of cooling fluid through the probe 112.

The lower end of probe 112 is shown in FIG. 7. In FIG. 9 the probe is shown in relation to vacuum furnace 120. The probe extends up from the disk 100 through a top opening provided by a flange 150 and conforming cover 142. Coolant fluid is introduced into inner tube 142 from an external source not shown and is removed through outer tube 144 which may be of copper or stainless steel, for example. Helium may be used as a coolant gas or water may be used as a coolant liquid. The pressure within vacuum furnace 120 may be adjusted by pumping gas out through side opening 154 attached to vacuum pumping equipment not shown. Conventional sensing, observation, testing and instrumentation not illustrated is used in connection with the operation of such a furnace also, conventional means to cool the furnace walls, not illustrated, are known in the art.

The foregoing is directed to improving the properties of a conventional jet engine disk structure. It is understood that blades are mechanically mounted to the rims of disks in conventional present practice for most jet engines. However it is now feasible to form structures which have such blades formed integrally with the disk and these structures are known as blisks in that they combine blades and disks into a single integrated structure. It will be understood that the method of the present invention is applicable to blisks as well as to disks.

What is claimed and sought to be protected by Letters Patent of the United States is as follows:

1. A method of providing superior operating characteristics to a disk of a jet engine formed of a $\gamma'$ strengthened nickel base superalloy and having an inner portion which operates in the jet engine at lower temperature and an outer portion which operates at higher temperatures which comprises, providing a disk having a small grain size throughout its structure and at both an outer rim portion and an inner bore portion, differentially heating said disk to about its annealing temperature to establish a temperature gradient of at least 50° C. over the radius of said disk to bring the rim portion of said disk to above its supersolvus annealing temperature but below its incipient melting temperature to substantially enlarge the grain size of the grains at the rim of said disk, and said differentially heating of said disk operating to heat the bore portion of said disk structure to a subsolvus annealing temperature to dissolve only a portion of the strengthening precipitate therein and to limit grain growth to less than that occurring in the rim portion of the disk, cooling the disk while preserving a radial temperature gradient therein to cool the bore portion of said disk at a rate which is at least twice as rapid as the rate at which the rim portion is cooled, to thereby impart a different set of mechanical properties to the bore portion as compared to those of the rim portion.

2. The method of claim 1 in which the nickel base superalloy is René 95.

3. The method of claim 1 in which the nickel base superalloy is Astroloy.

4. The method of claim 1 in which the nickel base superalloy has a gamma prime strengthening precipitate in excess of 40 volume percent.

5. The method of claim 1 in which the temperature gradient is above 100° C.

6. The method of claim 1 in which the disk is a blisk.

* * * * *